US009986341B2

(12) United States Patent
Miyoshi

(10) Patent No.: US 9,986,341 B2
(45) Date of Patent: May 29, 2018

(54) ELECTROACOUSTIC CONVERTER

(71) Applicant: FUJIFILM Corporation, Tokyo (JP)

(72) Inventor: Tetsu Miyoshi, Ashigara-kami-gun (JP)

(73) Assignee: FUJIFILM Corporation, Tokyo (JP)

( * ) Notice: Subject to any disclaimer, the term of this patent is extended or adjusted under 35 U.S.C. 154(b) by 0 days. days.

(21) Appl. No.: 15/279,949

(22) Filed: Sep. 29, 2016

(65) Prior Publication Data

US 2017/0019737 A1 Jan. 19, 2017

Related U.S. Application Data

(63) Continuation of application No. PCT/JP2015/059494, filed on Mar. 26, 2015.

(30) Foreign Application Priority Data

Mar. 31, 2014 (JP) ..... 2014-073354

(51) Int. Cl.
*H04R 25/00* (2006.01)
*H04R 17/00* (2006.01)
(Continued)

(52) U.S. Cl.
CPC ..... *H04R 17/005* (2013.01); *H04R 7/18* (2013.01); *H04R 31/00* (2013.01); *H04R 7/12* (2013.01); *H04R 2400/11* (2013.01)

(58) Field of Classification Search
CPC ... H04R 17/00; H04R 17/005; H04R 2217/01
See application file for complete search history.

(56) References Cited

U.S. PATENT DOCUMENTS 3,973,150 A * 8/1976 Tamura ..... H04R 17/005 310/334
3,997,804 A * 12/1976 Tamura ..... H04R 17/005 310/322

(Continued)

FOREIGN PATENT DOCUMENTS

JP 53-59473 A 5/1978
JP 2014-17799 A 1/2014
WO WO 2013047872 A1 * 4/2013 ..... H04R 17/005

OTHER PUBLICATIONS

International Preliminary Report on Patentability and Written Opinion of the International Searching Authority (Forms PCT/IB/338, PCT/IB/326, PCT/IB/373 and PCT/ISA/237), dated Oct. 13, 2016, for International Application No. PCT/JP2015/059494, including English translation.

(Continued)

*Primary Examiner* — Matthew Eason
*Assistant Examiner* — Ryan Robinson
(74) *Attorney, Agent, or Firm* — Birch, Stewart, Kolasch & Birch, LLP

(57) ABSTRACT

An electroacoustic converter includes a piezoelectric film whose principal surface expands and contracts according to an electric field, a viscoelastic support which is in close contact with the principal surface of the piezoelectric film, a pressing member which presses the piezoelectric film to the viscoelastic support, and an expandable pressing sheet which is tensioned and in close contact with the surface of the piezoelectric film opposite to the viscoelastic support to press the piezoelectric film and the viscoelastic support. In a section in a predetermined direction perpendicular to the principal surface of the piezoelectric film, the piezoelectric film has a flat portion which is held by the pressing sheet and the viscoelastic support in a portion thereof excluding a pressed portion by the pressing member, and an inclined portion which is connected to the pressed portion and the flat portion and extends in a direction of intersecting the pressed (Continued)

portion. With this, an electroacoustic converter having excellent acoustic characteristics and stab resistance is provided.

12 Claims, 5 Drawing Sheets

(51) Int. Cl.

| | |
|---|---|
| ***H04R 7/18*** | (2006.01) |
| ***H04R 31/00*** | (2006.01) |
| *H04R 7/12* | (2006.01) |

(56) References Cited

U.S. PATENT DOCUMENTS 4,024,355 A * 5/1977 Takahashi ..... H04R 7/24 310/324
4,045,695 A * 8/1977 Itagaki ..... H04R 17/005 310/322
4,088,915 A * 5/1978 Kodama ..... H04R 17/005 310/334
4,578,613 A * 3/1986 Posthuma de Boer ..... B06B 1/0688 310/311
6,522,760 B2 * 2/2003 Azima ..... H04R 1/24 381/152
9,398,378 B2 * 7/2016 Miyazato ..... H04R 7/04
2010/0239109 A1 * 9/2010 Lutz ..... H04R 7/18 381/190

OTHER PUBLICATIONS

International Search Report, issued in PCT/JP2015/059494, PCT/ISA/210, dated Jun. 16, 2015.

* cited by examiner

ELECTROACOUSTIC CONVERTER

CROSS-REFERENCE TO RELATED APPLICATIONS

This application is a Continuation of PCT International Application No. PCT/JP2015/059494 filed on Mar. 26, 2015, which claims priority under 35 U.S.C. § 119(a) to Japanese Patent Application No. 2014-073354 filed on Mar. 31, 2014. The above application is hereby expressly incorporated by reference, in its entirety, into the present application.

BACKGROUND OF THE INVENTION

1. Field of the Invention

The present invention relates to an electroacoustic converter which is used for a thin piezoelectric speaker, microphone, or the like using a piezoelectric film as a vibrating body.

2. Description of the Related Art

A so-called piezoelectric film in which electrode layers are formed on both surfaces of a sheet-like piezoelectric material, such as a polymeric piezoelectric material, for example, a uniaxially stretched polyvinylidene fluoride (PVDF) film, or a polymeric composite piezoelectric body in which a piezoelectric material in a powder form is dispersed in a polymer material as a matrix has the property of expanding and contracting in response to an applied voltage. In order to use this piezoelectric film as a speaker, it is necessary to convert expansion and contraction movement along the film surface to vibration in a direction perpendicular to the film surface. The conversion from expansion and contraction movement to vibration is achieved by maintaining the piezoelectric film in a curved state, and with this, it is possible to make the piezoelectric film function as a speaker.

However, in general, the piezoelectric film itself has low stiffness. For this reason, if the area of the speaker becomes larger, the piezoelectric film is bent due to the weight thereof, and it is difficult to maintain the piezoelectric film in the curved state. For this reason, there is a limit to the increase in size of a speaker using a piezoelectric film.

In regard to this problem, a mechanical bias is applied to the piezoelectric film. For example, JP1978-59473A (JP-S53-59473A) describes an electroacoustic converter (portable sound generation device) in which thin-film electrodes are formed on both surfaces of a polymeric piezoelectric material sheet by vapor deposition or the like, one end of the thin-film electrode is fixed to a case through a backing, and the other thin-film electrode is brought into press-contact with a conductive film formed on a member applying a mechanical bias.

JP1978-59473A (JP-S53-59473A) describes a member having a loose curvature as a member applying a mechanical bias for use in an electroacoustic converter.

Specifically, a configuration is described in which both ends of the piezoelectric film in the expansion and contraction direction are fixed to a mounting plate with gaps therebetween on both sides substantially parallel to the expansion and contraction direction, and the thin-film electrode on the side of the piezoelectric film opposite to a sonic wave radiation direction is pressed to a member having a curvature through a ground plate, thereby providing electrical conduction between the member having a loose curvature and the ground plate.

In the electroacoustic converter described in JP1978-59473A (JP-S53-59473A), the piezoelectric film with the periphery fixed has a curved shape in which the piezoelectric film is pressed to the member having a loose curvature for applying a mechanical bias.

In this electroacoustic converter, the member applying a mechanical bias has a loose curvature, whereby it is possible to apply a constant mechanical bias at any location of the piezoelectric film. For this reason, the expansion and contraction movement of the piezoelectric film is converted to forth-back movement without waste, and sound corresponding to supplied power is generated.

In JP1978-59473A (JP-S53-59473A), the electroacoustic converter has such a configuration, whereby it is possible to freely select a timbre over a wide frequency band and to achieve reduction in the number of parts, simplification of a configuration or a reliable mechanism, or the like.

However, if the piezoelectric film has a curvature, since the piezoelectric film is curved, there is a restriction on an installation place or a mounting method, and it is not suitable for the purposes of wall-mounting or installing on the rear surface of a picture, a poster, a decoration plate, or the like. If the area of the speaker becomes larger, the thickness of the piezoelectric file becomes larger even if the piezoelectric film has a loose curvature, and the original feature as the thin speaker is degraded.

In order to compensate for such a problem, the curvature of the piezoelectric film may be made small. That is, the radius of curvature may be made large. However, if the piezoelectric film is made nearly planar, it is not possible to convert the expansion and contraction movement of the piezoelectric film to the forth-back movement, sound is not emitted, and a sound pressure (sound volume) is made small.

In contrast, the inventors have suggested an electroacoustic converter having a piezoelectric film which contracts with application of a drive voltage, a viscoelastic support which is in close contact with one surface of the piezoelectric film, and a pressing member which presses a peripheral portion of the piezoelectric film to press the piezoelectric film to the viscoelastic support, the piezoelectric film having a flat portion which is supported linearly by the surface of the viscoelastic support and an inclined portion which is formed in the outer circumference of the flat portion and is inclined from the flat portion toward a pressing position by the pressing member (JP2014-17799A).

SUMMARY OF THE INVENTION

According to the electroacoustic converter described in JP2014-17799A, when the piezoelectric film contracts with application of the drive voltage, the inclined portion formed in the outer circumference of the flat portion changes in angle in a tilting direction, that is, in a direction of becoming nearly planar so as to absorb the contraction, and conversely, in a case where the piezoelectric film expands, the inclined portion changes in angle in a rising direction, that is, in a direction of becoming nearly at 90° so as to absorb the expansion.

While the viscoelastic support is brought into a compressed state in a thickness direction when approaching the pressing position in the inclined portion, the mechanical bias which is substantially the same as that for the flat portion with a static viscoelasticity effect (stress relaxation) can be applied to the piezoelectric film. As a result, it is possible to maintain a constant mechanical bias at any location of the piezoelectric film, and similarly to a case of using the member having a loose curvature, the expansion and contraction movement of the piezoelectric film is converted to the forth-back movement without waste.

For this reason, according to the electroacoustic converter described in JP2014-17799A, it is possible to obtain a planar electroacoustic converter which is thin, obtains a sufficient sound volume, and has excellent acoustic characteristics.

However, in recent years, requirements for an electroacoustic converter for use in a thin speaker or the like have been tightened further, and there has been demand for introduction of an electroacoustic converter having excellent acoustic characteristics.

An object of the invention is to solve the problems in the related art and to provide an electroacoustic converter which is thin, has excellent frequency characteristics or acoustic characteristics, such as a sound volume, and can prevent damage in a case of stabbing with a rod or the like.

In order to attain the above-described object, an electroacoustic converter of the invention comprises a piezoelectric film which has two principal surfaces facing each other, the principal surfaces expanding and contracting according to the state of an electric field, a viscoelastic support which is disposed in close contact with one principal surface of the piezoelectric film, a pressing member which presses the piezoelectric film to the viscoelastic support to maintain the thickness of at least a part of the viscoelastic support in a thinned state, and an expandable pressing sheet which is in close contact with the principal surface of the piezoelectric film opposite to the side in close contact with the viscoelastic support to press the piezoelectric film and the viscoelastic support and is supported in a tensioned state. In a section in a predetermined direction perpendicular to the principal surfaces of the piezoelectric film, the piezoelectric film has a flat portion which is substantially held linearly by the surfaces of the pressing sheet and the viscoelastic support in at least a portion thereof excluding the pressed portion pressed by the pressing member and an inclined portion which is connected to the pressed portion and the flat portion and extends in a direction of intersecting the pressed portion.

In the electroacoustic converter of the invention, it is preferable that the pressing sheet is supported by a frame body having ridges on the same plane while covering the ridges and an opening of the frame body.

It is preferable that the pressing sheet is supported by the frame body in a planar shape in a tensioned state.

It is preferable that the inclined portion has a curved portion.

It is preferable that the curved portion has a region where the curvature thereof becomes larger in a direction from the flat portion toward the pressing member.

It is preferable that the pressing sheet is jersey fabric.

It is preferable that the stitch of the jersey fabric is any one of plain, fraise, span fraise, smooth, punch, sweat, and rib.

It is preferable that the piezoelectric film has a polymeric composite piezoelectric body in which piezoelectric body particles are dispersed in a viscoelastic matrix made of a polymer material having viscoelasticity at normal temperature and electrode layers provided with the polymeric composite piezoelectric body interposed therebetween.

It is preferable that the viscoelastic support is glass wool.

It is preferable that the specific gravity of the glass wool is 10 to 32 kg/m$^3$.

According to the electroacoustic converter of the invention, it is possible to make the flat portion of the piezoelectric film larger than in the electroacoustic converter of the related art described in JP2014-17799A or the like. In addition, the piezoelectric film is not only pressed from below by the viscoelastic support, but also is pressed from above by the pressing sheet. That is, in the electroacoustic converter of the invention, a force is applied substantially evenly to the piezoelectric film in a forth-back direction in which the piezoelectric file vibrates. In other words, in the electroacoustic converter of the invention, a force is applied substantially evenly to the piezoelectric film in a direction orthogonal to a vibrating surface of the piezoelectric film.

For this reason, according to the electroacoustic converter of the invention, it is possible to make the large flat portion move in a forth-back direction while preventing asymmetry in the forth-back direction, and to allow excellent acoustic characteristics to be exhibited with distortion due to the asymmetry of the forth-back movement suppressed. Furthermore, since the pressing sheet also operates as a protective sheet, for example, even in a case of stabbing with a rod or the like, it is possible to prevent damage to the piezoelectric film. In addition, it is possible to make the electroacoustic converter have a design characteristic by selecting the color, pattern, or the like of the pressing sheet.

DESCRIPTION OF THE PREFERRED EMBODIMENTS

Hereinafter, an electroacoustic converter of the invention will be described in detail based on a suitable example shown in the accompanying drawings.

Figure 1:
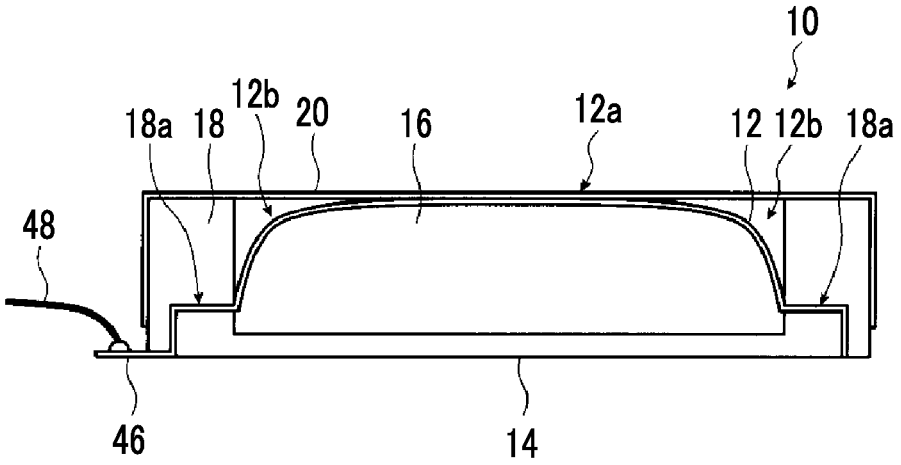
FIG. 1 is a diagram conceptually showing an example of an electroacoustic converter of the invention.

FIG. 1 conceptually shows an example of the electroacoustic converter of the invention.

An electroacoustic converter 10 shown in FIG. 1 basically has a piezoelectric film 12, a case 14, a viscoelastic support 16, a pressing member 18, and a pressing sheet 20.

In the electroacoustic converter 10 of the invention, the piezoelectric film 12 is pressed to the viscoelastic support 16 by the pressing sheet 20 and the pressing member 18, and the viscoelastic support 16 is compressed. With the pressing of the piezoelectric film 12 and the compression of the viscoelastic support 16, the piezoelectric film 12 has a central flat portion 12*a* which substantially has a planar shape and a peripheral inclined portion (rising portion) 12*b* which is inclined (lowered) from the flat portion 12*a* toward a pressed portion by the pressing member 18.

The case 14 is a member which houses the viscoelastic support 16 and fixes the piezoelectric film 12 along with the pressing member 18. The case 14 is a thin housing which is formed of, for example, plastic or the like, and has an open top surface.

As the shape of the case 14, various shapes are available according to the purpose or the like of the electroacoustic converter 10. As an example, a square cylindrical shape, a cylindrical shape, or an elliptical cylindrical shape is illustrated. The depth of the cylindrical portion (central recess portion) of the case 14 is smaller than the height (thickness) of the viscoelastic support 16.

The viscoelastic support 16 has proper viscosity and elasticity, supports the piezoelectric film 12, and applies a constant mechanical bias at any location of the piezoelectric film 12 to convert the expansion and contraction movement of the piezoelectric film 12 to the forth-back movement without waste. That is, the viscoelastic support 16 converts the expansion and contraction movement of the piezoelectric film 12 to movement in a direction perpendicular to the surface of the film without waste.

As described above, the viscoelastic support 16 is housed in the cylindrical portion of the case 14. The height of the viscoelastic support 16 is larger than the depth of the cylindrical portion of the case 14.

The material of the viscoelastic support 16 is not particularly limited insofar as the material has proper viscosity and elasticity and is suitably deformed without obstructing the vibration of the piezoelectric film. Specifically, a fiber material, such as wool felt or glass wool containing a polyester fiber, such as rayon or PET, or a foaming material (foaming plastic), such as polyurethane, is preferably used.

Of these, glass wool is suitably used in terms of excellent acoustic characteristics, excellent weather resistance, flame resistance, or the like.

In a case where glass wool is used as the viscoelastic support, it is preferable that the specific gravity of the glass wool is 10 to 32 kg/m$^3$. Glass wool having a specific gravity of 10 to 32 kg/m$^3$ is preferably used from the viewpoint of suitably forming the flat portion 12*a* and the inclined portion 12*b* of the piezoelectric film 12, reducing the asymmetry of the forth-back movement of the piezoelectric film 12, or the like.

The viscoelastic support 16 is pressed toward the case 14 by the piezoelectric film 12 and the pressing sheet 20 even in a portion corresponding to the flat portion 12*a*.

In the flat portion 12*a*, it is preferable that a surface pressure when the piezoelectric film 12 and the pressing sheet 20 press the viscoelastic support 16 is 0.005 to 1 MPa, and in particular, 0.02 to 0.2 MPa. The surface pressure when the piezoelectric film 12 and the pressing sheet 20 press the viscoelastic support 16 is, that is, a surface pressure when the viscoelastic support 16 presses the flat portion 12*a* of the piezoelectric film 12.

The surface pressure pressing the flat portion 12*a* is preferably set in the above-described range from the viewpoint of increasing the area of the flat portion 12*a*, reducing the asymmetry of the forth-back movement of the piezoelectric film 12, or the like.

The piezoelectric film 12 is a thin film (film-like substance) which has piezoelectricity and expands and contracts in an in-plane direction according to the state of an electric field.

As shown in FIG. 1, the piezoelectric film 12 is disposed so as to cover the viscoelastic support 16 and the case 14. The piezoelectric film 12 presses the viscoelastic support 16 by pressing and fixing the marginal portion of the piezoelectric film 12 to the edge portion of the case 14 by the pressing member 18 described below. Accordingly, the central portion of the piezoelectric film 12 is pressed in a direction opposite to the case 14 by the viscoelastic support 16.

With the pressing of the viscoelastic support 16 by the piezoelectric film 12 and the pressing sheet 20 described below and the fixing of the piezoelectric film 12 to the case 14 by the pressing member 18, in the periphery of the piezoelectric film 12, the inclined portion 12*b* which is curved and lowered gradually toward the pressed portion with a curvature rapidly varying toward the pressing member 18, and in the central portion, the flat portion 12*a* which substantially has a planar shape is formed. The periphery of the piezoelectric film 12 is, that is, a region near the pressing member 18.

In the inclined portion 12*b*, the viscoelastic support 16 is brought into a compressed state in the thickness direction when approaching the pressed portion (fixed position) of the piezoelectric film 12 by the pressing member 18. However, with the static viscoelasticity effect (stress relaxation) by the viscoelastic support 16, it is possible to maintain a constant mechanical bias at any location of the piezoelectric film 12.

With this, similarly to a case where a member having a loose curvature is used, since the expansion and contraction movement of the piezoelectric film 12 is converted to the forth-back movement without waste, it is possible to obtain the planar electroacoustic converter 10 which is thin, obtains a sufficient sound volume, and has excellent acoustic characteristics. For this reason, the electroacoustic converter 10 of the invention can reduce a restriction on an installation place or a mounting method, and can be mounted on a wall or installed on the rear surface of a picture, a poster, a decoration plate, or the like.

The intersecting angle between the inclined portion 12*b* and the pressed portion of the piezoelectric film 12 by the pressing member 18 is preferably 3° to 90°, and more preferably, 10° to 60°.

With the angle of the inclined portion 12*b* set in this range, since the flat portion 12*a* of the piezoelectric film 12 can sufficiently move in the forth-back movement, that is, vibrate according to the expansion and contraction of the piezoelectric film 12, it is possible to reproduce sound with excellent accuracy and to obtain a sufficient sound volume.

Figure 2:
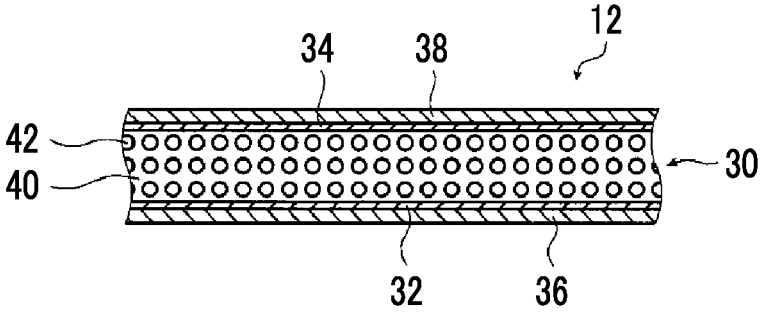
FIG. 2 is a diagram conceptually showing an example of a piezoelectric film used in the electroacoustic converter shown in FIG. 1.

FIG. 2 is a schematic sectional view showing a part of the piezoelectric film 12.

The piezoelectric film 12 basically has a piezoelectric layer 30 which is made of a polymeric composite piezoelectric body, a thin film electrode 32 and a thin film electrode 34 which are respectively provided on one surface and the other surface of the piezoelectric layer 30, a protective layer 36 which is provided on the surface of the thin film electrode 32, and a protective layer 38 which is provided on the surface of the thin film electrode 34.

The piezoelectric layer 30 is made of a polymeric composite piezoelectric body as described above.

The polymeric composite piezoelectric body forming the piezoelectric layer 30 has piezoelectric body particles 42 evenly dispersed in a matrix 40 made of a polymer material. Preferably, the piezoelectric layer 30 is subjected to polling (polarization processing).

In FIG. 2, although the piezoelectric body particles 42 in the piezoelectric layer 30 are dispersed in the matrix 40 with regularity, the piezoelectric body particles 42 may be dispersed irregularly.

In the electroacoustic converter 10 of the invention, preferably, for the piezoelectric layer 30, the matrix (viscoelastic matrix) 40 which is made of a polymer material having viscoelasticity at normal temperature is used. In this specification, the "normal temperature" indicates a temperature range of about 0° C. to 50° C.

Specific examples of the polymer material having viscoelasticity at normal temperature include cyanoethylated polyvinyl alcohol (cyanoethylated PVA), polyvinyl acetate, polyvinylidene chloride coacrylonitrile, a polystyrene-vinylpolyisoprene block copolymer, polyvinylmethylketone, polybutylmethacrylate, and the like. Of these, cyanoethylated PVA is suitably used. As these polymer materials, a commercial product, such as HYBRAR 5127 (manufactured by KURARAY CO., LTD.), is suitably available.

These polymer materials may be used alone or a plurality of polymer materials may be used in combination (in a mixture).

Accordingly, the piezoelectric layer 30 with the matrix 40 made of cyanoethylated PVA has a high viscoelasticity effect, and is very suitable without causing cracks or the like inside the piezoelectric layer 30 even at a location where the curvature near the pressing member 18 rapidly changes, since stress concentration at the interface between the polymeric viscoelastic matrix and the piezoelectric body particles is relaxed.

The matrix 40 is not limited to a single polymer material having viscoelasticity at normal temperature, and may be formed of a material in which at least one of a fluorine-based polymer, such as polyvinylidene fluoride, vinylidene fluoride-tetrafluoroethylene copolymer, vinylidene fluoride-trifluoroethylene copolymer, polyvinylidene fluoride-trifluoroethylene copolymer, and polyvinylidene fluoride-tetrafluoroethylene copolymer, which are high dielectric or ferrodielectric polymers, a polymer having a cyano group or a cyanoethyl group, such as a vinylidene cyanide-vinyl acetate copolymer, cyanoethylcellulose, cyanoethyl hydroxy saccharose, cyanoethylhydroxycellulose, cyanoethylhydroxypullulan, cyanoethyl methacrylate, cyanoethyl acrylate, cyanoethylhydroxyethyl cellulose, cyanoethyl amylose, cyanoethylhydroxypropylcellulose, cyanoethyl dihydroxypropyl cellulose, cyanoethyl hydroxypropyl amylose, cyanoethylpolyacrylamide, cyanoethylpolyacrylate, cyanoethylpullulan, cyanoethylpolyhydroxymethylene, cyanoethylglycidolpullulan, cyanoethyl saccharose, and cyanoethylsorbitol, or synthetic rubber, such as nitrile rubber and chloroprene rubber, is added to cyanoethylated PVA.

The matrix 40 preferably contains a polymer material, such as cyanoethylated PVA, having viscoelasticity at normal temperature, but is not limited thereto. For example, cyanoethylated pullulan or the like may be used.

The piezoelectric body particles 42 are particles of a piezoelectric body. The piezoelectric body particles 42 are preferably made of ceramics particles having a perovskite crystal structure.

Examples of the ceramics particles constituting the piezoelectric body particles 42 include lead zirconate titanate (PZT), lead lanthanum zirconate titanate (PLZT), barium titanate ($BaTiO_3$), and a solid solution (BFBT) of barium titanate and bismuth ferrite ($BiFe_3$), and the like.

The particle size of the piezoelectric body particles 42 is not particularly limited, and may be appropriately set according to the size of the piezoelectric film 12, the use of the piezoelectric film 12, the characteristics required for the piezoelectric film 12, and the like.

The ratio between the amount of the matrix 40 and the amount of the piezoelectric body particles 42 in the piezoelectric layer 30 (polymeric composite piezoelectric body) is not particularly limited. That is, the ratio between the amount of the matrix 40 and the amount of the piezoelectric body particles 42 may be appropriately set according to the size of the piezoelectric film 12, in particular, the size or thickness in the surface direction, the use of the piezoelectric film 12, the characteristics required for the piezoelectric film 12, and the like.

In this example, although the polymeric composite piezoelectric body is used as the piezoelectric layer 30, the invention is not limited thereto, and a polymer piezoelectric material, such as polyvinylidene fluoride (PVDF), having piezoelectricity may be used.

While uniaxially stretched PVDF has in-plane anisotropy in the piezoelectric characteristics, the polymeric composite piezoelectric body preferably has no in-plane anisotropy from the viewpoint of more suitably converting the expansion and contraction movement to the forth-back movement and obtaining sufficient sound volume and sound quality compared to PVDF.

The thickness of the piezoelectric layer 30 is not particularly limited, and may be appropriately set according to the size of the piezoelectric film 12, the use of the piezoelectric film 12, and the characteristics required for the piezoelectric film 12, and the like.

According to the examination conducted by the inventors, the thickness of the piezoelectric layer 30 is preferably 10 to 300 more preferably, 20 to 200 μm, and particularly preferably, 30 to 100 μm.

The thickness of the piezoelectric layer 30 is preferably set in the above-described range from the viewpoint of securing strength of the piezoelectric film 12 and achieving proper flexibility suitable for the forth-back movement (vibration).

In the piezoelectric film 12, the thin film electrode 32 is provided on one surface of the piezoelectric layer 30, and the thin film electrode 34 is provided on the other surface of the piezoelectric layer 30. That is, the thin film electrodes are formed on both surfaces of the piezoelectric layer 30 with the piezoelectric layer 30 interposed therebetween.

The thin film electrodes 32 and 34 are electrodes for applying a drive voltage to the piezoelectric layer 30.

The material forming the thin film electrodes 32 and 34 is not particularly limited, and various conductors are available. Specific examples thereof include C, Pd, Fe, Sn, Al, Ni, Pt, Au, Ag, Cu, Cr, Mo, and alloys thereof. Furthermore, transparent conductive films, such as indium tin oxide (ITO), indium zinc oxide (IZO), tin oxide, and zinc oxide, are available as the thin film electrodes 32 and 34.

The forming method of the thin film electrode 32 is not particularly limited, and various known methods, such as film formation by a vapor-phase deposition method (vacuum film forming method), such as vacuum deposition or sputtering, and a method in which foil formed of the above-described material is adhered to the piezoelectric layer, are available.

Of these, in particular, a thin film of copper or aluminum formed by vacuum deposition is suitable used as the thin film electrodes 32 and 34 since flexibility of the piezoelectric film 12, that is, the magnitude of the forth-back movement can be secured, a thin electrode layer which does not restrict deformation of the piezoelectric layer can be formed, or the like.

The thickness of the thin film electrodes 32 and 34 is not particularly limited, but is preferably equal to or less than 1 μm. The thin film electrodes 32 and 34 basically have the same thickness, but the thickness may be different.

It is preferable that the thickness of the thin film electrodes 32 and 34 is small in a possible range. However, in a case of the large piezoelectric film 12, since the influence of the thickness may be negligible, the thickness of the thin film electrodes 32 and 34 may be appropriately determined according to the size of the piezoelectric film 12, the performance or characteristics required for the piezoelectric film 12, handleability, and the like.

The relationship between the thickness of the thin film electrodes 32 and 34 and the size of the piezoelectric film 12 is the same as the relationship between the protective layers 36 and 38 and the size of the piezoelectric film 12 described below in detail.

The thin film electrode 32 and/or the thin film electrode 34 is not necessarily formed on the entire surface of the piezoelectric layer 30 (protective layer 36 and/or 38).

That is, at least one of the thin film electrode 32 or the thin film electrode 34 may be smaller than, for example, the piezoelectric layer 30, and in the peripheral portion of the piezoelectric film 12, the piezoelectric layer 30 and the protective film may be in direct contact with each other.

The protective layer 36 is provided on the surface of the thin film electrode 32, and the protective layer 38 is provided on the surface of the thin film electrode 34.

The protective layers 36 and 38 protect the piezoelectric layer 30 and the thin film electrodes 32 and 34, and operate as support layers supporting the piezoelectric film 12.

The protective layers 36 and 38 are not particularly limited, and various sheet-like substances are available. Suitable examples thereof include various resin films. Of these, films made of polyethylene terephthalate (PET), polypropylene (PP), polystyrene (PS), polycarbonate (PC), polyphenylene sulfite (PPS), polymethyl methacrylate (PMMA), polyetherimide (PEI), polyimide (PI), polyethylene naphthalate (PN), triacetyl cellulose (TAC), polyethylene naphthalate (PEN), cyclic olefin-based resin, and the like are suitably used since these have excellent mechanical strength and heat resistance, or the like.

The thickness of the protective layers 36 and 38 is not particularly limited. The protective layers 36 and 38 basically have the same thickness, but the thickness may be different.

Similarly to the above-described thin film electrode 32 and the like, if the stiffness of the protective layers 36 and 38 is high, since the expansion and contraction of the piezoelectric layer 30 is restricted, as a result, the amplitude of the forth-back movement of the piezoelectric film becomes small. Accordingly, considering the performance of the electroacoustic converter 10, the thinner the protective layers 36 and 38 are, the more advantageous the protective layers 36 and 38 are.

Meanwhile, as described above, the thinner the protective layers 36 and 38 are, the more difficult handling of the protective layers 36 and 38 is since resin films are used.

The protective layers 36 and 38 also have an operation as a support of the piezoelectric film 12, but if the protective layer is too thin, sufficient functions as the protective layer and the support cannot be exhibited. In addition, in a case where mechanical strength or favorable handleability as a sheet-like substance is required for the piezoelectric film 12, the thicker the protective layers 36 and 38 are, the more advantageous the protective layers 36 and 38 are.

However, if the protective layers 36 and 38 are thick and stiffness is too high, since the expansion and contraction of the piezoelectric layer 30 is restricted, or flexibility is damaged, the thinner the protective layers 36 and 38 are, the more advantageous the protective layers 36 and 38 are except for a case where mechanical strength or favorable handleability as a sheet-like substance is required.

Accordingly, the thickness of the protective layers 36 and 38 may be appropriately set according to acoustic performance required for the piezoelectric film 12, that is, an acoustic device, handleability required for the piezoelectric film 12, mechanical strength required for the piezoelectric film 12, and the like.

According to the examination conducted by the inventors, if the thickness of the protective layer is equal to or less than two times the thickness of the piezoelectric layer 30, it is possible to obtain preferable effects from the viewpoint of securing stiffness and achieving proper flexibility.

For example, in a case where the thickness of the piezoelectric layer 30 is 50 μm and the protective layers 36 and 38 are made of PET, the thickness of the protective layers 36 and 38 is preferably equal to or less than 100 μm, more preferably, equal to or less than 50 μm, and particularly preferably, equal to or less than 25 μm.

As a method of manufacturing the piezoelectric film 12, a method in which a component, such as cyanoethylated PVA, to be the matrix 40 is dissolved in a solvent, the piezoelectric body particles 42, such as PZT particles, are added and dispersed by stirring to prepare a paint, the paint is casted (applied) to the sheet-like substance in which the thin film electrode 32 is formed on the protective layer 36, the organic solvent is dried by evaporation, a sheet-like substance in which the thin film electrode 34 is formed on the protective layer 38 is laminated and subjected to thermocompression bonding is illustrated.

Alternatively, a component, such as cyanoethylated PVA, to be the matrix 40 may be melted by heating, the piezoelectric body particles 42 may be added to/dispersed in the component to prepare a melted material, the melted material may be extruded in the form of sheet onto the sheet-like substance by extrusion or the like and cooled to form the piezoelectric layer 30. As the sheet-like substance, as an example, a sheet-like substance in which the thin film electrode 32 is formed on the protective layer 36 is illustrated.

It is preferable that the piezoelectric layer 30 is subjected to polarization processing (polling) after the paint applied in the form of sheet-like substance is dried.

In the end portion of the piezoelectric film 12, an electrode lead-out portion 46 which is connected to the thin film electrodes 32 and 34 to lead out a wiring is provided. A wiring 48 which drives the electroacoustic converter 10 is connected to the electrode lead-out portion 46. The electrode lead-out portion 46 may be formed of, for example, copper foil.

In the example shown in the drawing, although only one electrode lead-out portion 46 is shown, the electrode lead-out portion 46 is provided corresponding to each of the thin film electrodes 32 and 34.

The pressing member 18 is a pressing member which presses and fixes the piezoelectric film 12, and is a frame body which is formed of metal, plastic, or the like.

In the example shown in the drawing, the pressing member 18 has a recess portion **18*a* which substantially has the same shape as the end portion (outer edge portion) of the case 14 in a lower end portion. The pressing member 18 fixes the recess portion 18*a* to the case 14 in a state where the piezoelectric film 12 is interposed between the recess portion 18*a* and the outer edge portion of the case 14, whereby the piezoelectric film 12 is pressed and fixed. As a method of fixing the recess portion 18*a* to the case 14, for example, a method of fitting the case 14 into the recess portion 18*a*** is illustrated.

As described above, the viscoelastic support 16 is higher than the depth of the cylindrical portion of the case 14.

Accordingly, the piezoelectric film 12 is pressed and fixed to the end portion of the case 14 by the pressing member 18, whereby the piezoelectric film 12 presses the viscoelastic support 16 to bring the thickness of the viscoelastic support 16 into a thinned state and the flat portion **12*a* and the inclined portion 12*b* described above are formed in the piezoelectric film 12**.

The fixing method of the pressing member 18 and the case 14 is not particularly limited, and various known fixing methods, such as fitting, screwing, and a method using a tool for fixing described above, are available.

As a method of fixing the piezoelectric film 12 to the pressing member 18 (case 14), in addition to pinching by fitting of the pressing member 18 and the case 14 described above, various known fixing methods for fixing the sheet-like substance, such as a method using an adhesive, screwing, a method using an adhesive tape, and a method using a magnet, are available.

In the electroacoustic converter 10 of the example shown in the drawing, the pressing member 18 not only fixes the piezoelectric film 12 to press the viscoelastic support 16 by the piezoelectric film 12 but also doubles as a frame body supporting the pressing sheet 20. The pressing member 18 is a frame body in which ridges are on the same plane, and supports the pressing sheet 20 on the plane by the top surface (ridges) thereof. Accordingly, the pressing sheet 20 which is supported in a state where the top surface of the pressing member 18 is tensioned is supported in a planar shape.

Although the top surface of the pressing member of the example shown in the drawing has a planar shape, the frame body supporting the pressing sheet 20 may have a top surface in a convex shape or the like if ridges are on the same plane.

The pressing sheet 20 is an expandable sheet-like substance which covers the piezoelectric film 12 to press the piezoelectric film 12 and the viscoelastic support 16.

As described above, in the electroacoustic converter 10, the pressing member 18 is a frame body in which ridges are on the same plane. The pressing sheet 20 is fixed to the pressing member 18 so as to cover the opening of the pressing member 18 as a frame body from above. As a method of fixing the pressing sheet 20 to the pressing member 18, similarly to the method of fixing the piezoelectric film 12 to the pressing member 18 described above, various known fixing methods of a sheet-like substance are available.

Though described below (see FIG. 3D), in a state where the piezoelectric film 12 is pressed and fixed by the pressing member 18, the flat portion 12*a* of the piezoelectric film 12 becomes higher than the top portion of the pressing member 18.

In the electroacoustic converter 10 shown in FIG. 1, the pressing sheet 20 is tensioned and fixed to the pressing member 18 such that the pressing sheet 20 is made substantially plane at the upper end (ridges) of the pressing member 18. With this, the viscoelastic support 16 is further pressed, and thus, the flat portion 12*a* becomes larger.

To the piezoelectric film 12, not only a pressing force by the viscoelastic support 16 from below but also a pressing force by the pressing sheet 20 from above is applied. For this reason, compared to a case where only the pressing force by the viscoelastic support 16 from below is applied, it is possible to suppress the occurrence of asymmetry in the forth-back movement of the piezoelectric film 12 described below, and an excellent acoustic characteristic with distortion suppressed is obtained.

For the pressing sheet 20, various sheet-like substances are available insofar as a sheet-like substance has expandability.

Specifically, jersey fabric, knit fabric, plush fabric, cut-and-sew fabric, mixed fabric with a synthetic fiber mixed, and the like are illustrated.

Of these, jersey fabric is suitably used from the viewpoint of achieving favorable expandability or flexibility, passability of sound generated by the piezoelectric film 12, weather resistance, lightweight, and the like.

The stitch of the jersey fabric is not particularly limited, but as the stitch of the jersey fabric, plain, fraise, span fraise, smooth, punch, sweat, rib, or the like is suitably used from the viewpoint of achieving favorable expandability or flexibility.

The pressing sheet 20 is required to be a substance which does not obstruct the expansion and contraction or the forth-back movement of the piezoelectric film 12. Accordingly, for the pressing sheet 20, a pressing sheet which has a low frictional force and is excellent in slidability on the piezoelectric film 12 is suitably used.

It is preferable that the pressing sheet 20 has multiple through holes like jersey fabric from the viewpoint of missing of sound generated by the piezoelectric film 12, or the like.

The thickness of the pressing sheet 20 is not particularly limited, and the thickness such that the expansion and contraction and the forth-back movement of the piezoelectric film 12 are not obstructed and the piezoelectric film 12 is pressed to thin the viscoelastic support 16 can be appropriately selected according to the expandability, strength, or the like of the pressing sheet 20.

According to the examination conducted by the inventors, the thickness of the pressing sheet 20 is preferably 0.1 to 2 mm, and more preferably, 0.3 to 1 mm.

The thickness of the pressing sheet 20 is preferably set in this range from the viewpoint of increasing the area of the flat portion 12*a*, reducing asymmetry of the forth-back movement of the piezoelectric film 12, improving stab resistance, or the like.

Hereinafter, the electroacoustic converter of the invention will be described in more detail by describing a method of manufacturing the electroacoustic converter 10 referring to the conceptual diagrams of FIGS. 3A to 4G.

Figure 3A:
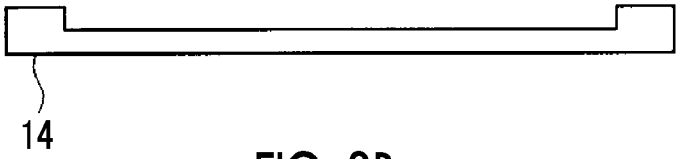
FIG. 3A to 3D are conceptual diagrams illustrating an example of a method of manufacturing the electroacoustic converter shown in FIG. 1.
Figure 3B:
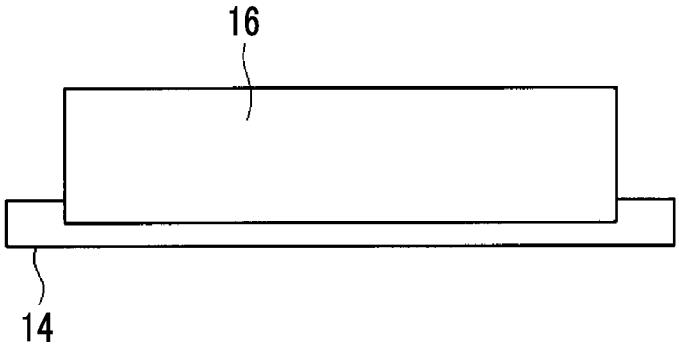

First, as shown in FIG. 3A, the housing-like case 14 with the open top is prepared. As shown in FIG. 3B, the viscoelastic support 16 having the same planar shape as the cylindrical portion is housed in the cylindrical portion (central recess portion) of the case 14. The planar shape is a shape when viewed from above in FIGS. 3A to 4G.

Though shown in FIG. 3B, as described above, the height (thickness) of the viscoelastic support 16 is higher than the depth of the cylindrical portion of the case 14.

Figure 3C:
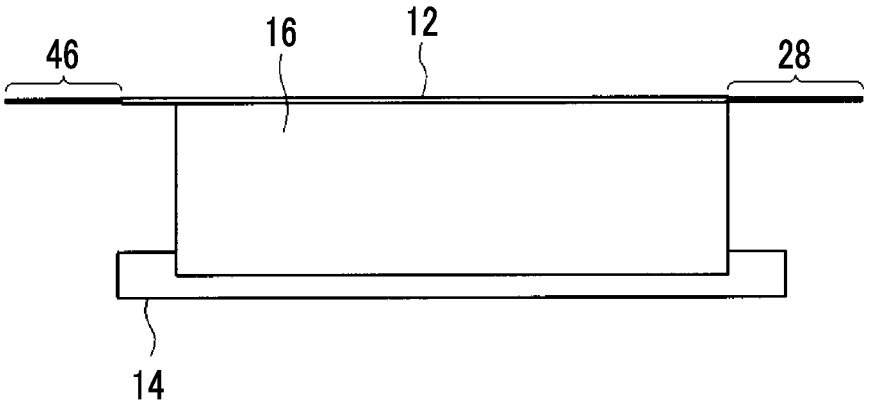

Next, as shown in FIG. 3C, the viscoelastic support 16 is covered with the piezoelectric film 12.

In the example shown in the drawing, a tab portion 28 for pulling the piezoelectric film 12 in the surface direction is attached to the outer circumference of the piezoelectric film 12. In the end portion of the piezoelectric film 12, the electrode lead-out portion 46 for leading out the electrodes is provided.

Figure 3D:
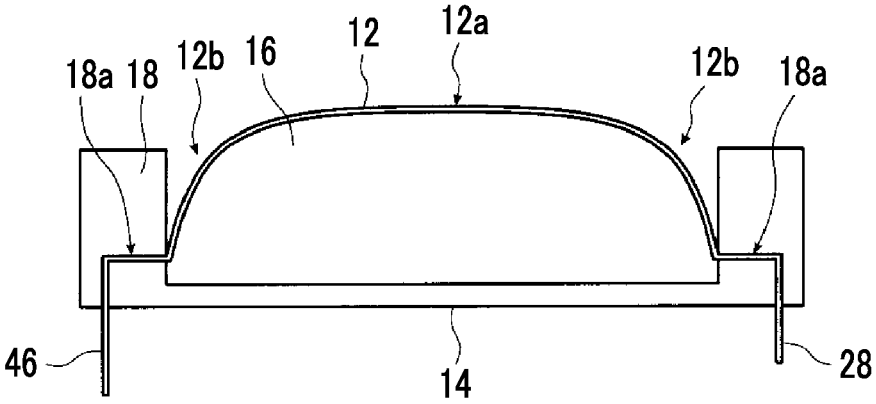

The viscoelastic support 16 is covered with the piezoelectric film 12, then, the pressing member 18 as a frame body is covered from above, as shown in FIG. 3D, the periphery of the piezoelectric film 12 is pushed down by the pressing member 18 and pressed to the end portion (edge portion) of the case 14, and in a state where the peripheral portion of the piezoelectric film 12 is interposed between the case 14 and the pressing member 18, the case 14 and the pressing member 18 are fixed.

With this, the viscoelastic support 16 is pressed by the piezoelectric film 12 and the viscoelastic support 16 is thinned as a whole. Furthermore, in the peripheral region (the region near the pressing member 18) of the piezoelectric film 12, the inclined portion 12*b* which is curved and lowered gradually toward the pressed portion with a curvature rapidly varying toward the pressing member 18, and in the central portion of the piezoelectric film 12, the flat portion 12*a* which substantially has a planar shape is formed.

The tab portion 28 is pulled as necessary, thereby eliminating wrinkles or the like in the piezoelectric film 12 and making the stretched state of the piezoelectric film 12 uniform.

The tab portion 28 protruding from the lower surfaces of the case 14 and the pressing member 18 is cut.

Figure 4E:
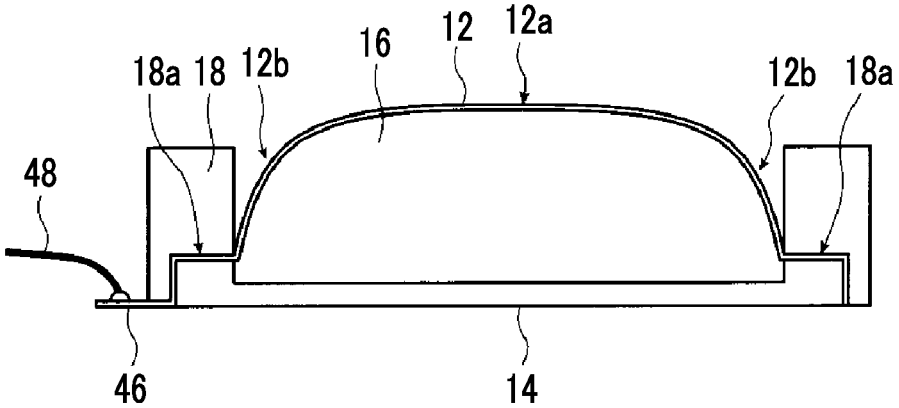
FIGS. 4E to 4G are conceptual diagrams illustrating an example of the method of manufacturing the electroacoustic converter shown in FIG. 1.

As shown in FIGS. 3D and 4E, in this state, the height of the piezoelectric film 12 is higher than the pressing member 18.

Next, as shown in FIG. 4E, the wiring 48 is connected to the electrode lead-out portion 46.

Figure 4F:
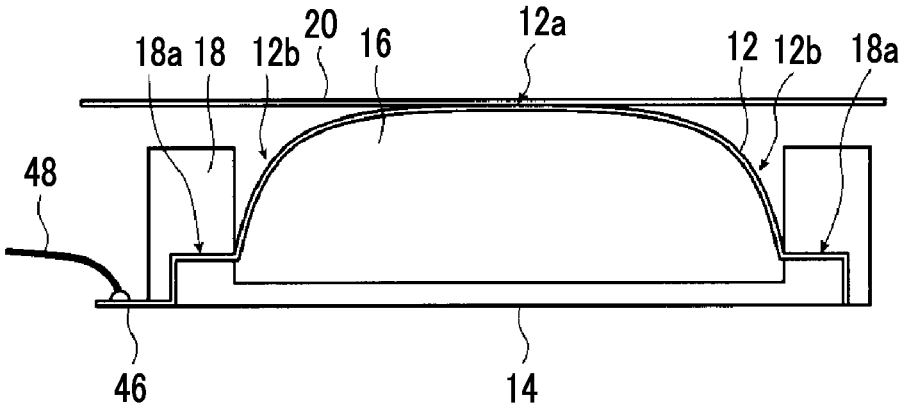

Next, as shown in FIG. 4F, the pressing sheet 20 is covered so as to cover the piezoelectric film 12 and the pressing member 18.

Figure 4G:
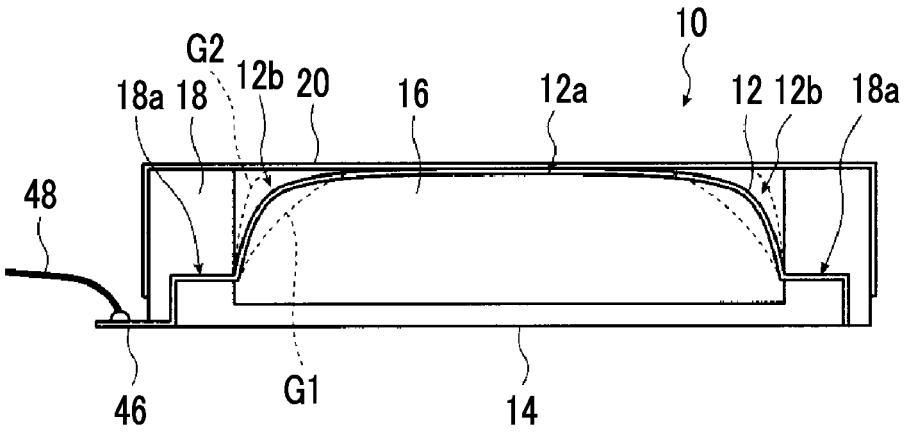

Next, as shown in FIG. 4G, the piezoelectric film 12 is pressed to press the viscoelastic support 16 so as to be thinned, and the pressing sheet 20 is tensioned and stretched such that the pressing sheet 20 is made (substantially) plane closing the opening of the pressing member 18. FIG. 4G is the same as FIG. 1. Specifically, the pressing sheet 20 outside the pressing member 18 is pulled downward, that is, toward the case 14 with the pressing member 18 as a support until a region of the pressing sheet 20 closing the opening of the pressing member 18 substantially has a planar shape.

With the pressing by the pressing sheet 20, the flat portion 12*a* of the piezoelectric film 12 becomes larger.

The pressing sheet 20 is bent downward in the outer end portion of the pressing member 18, the pressing sheet 20 is fixed to the pressing member 18, and the electroacoustic converter 10 is completed.

As shown in FIGS. 1 and 4G, the entire viscoelastic support 16 of the electroacoustic converter 10 after assembling is pressed toward the case 14 by the piezoelectric film 12 and the pressing sheet 20, and the whole thickness is thinned compared to a state before assembling. That is, in the electroacoustic converter 10 after assembling, the viscoelastic support 16 is compressed not only in the inclined portion 12*b* but also in the flat portion 12*a* and thinned.

In the inclined portion (rising portion) 12*b*, while the viscoelastic support 16 is brought into the compressed state in the thickness direction when approaching the pressing member 18, the mechanical bias which is substantially the same as that for the flat portion 12*a* with the static viscoelasticity effect (stress relaxation) can be applied to the piezoelectric film 12. As a result, it is possible to maintain a constant mechanical bias at any location of the piezoelectric film 12, and similarly to a case of using a member having a loose curvature, the expansion and contraction movement of the piezoelectric film is converted to the forth-back movement without waste; thus, it is possible to obtain a planar electroacoustic converter which is thin, obtains a sufficient sound volume, and has excellent acoustic characteristics.

That is, if an AC drive voltage is applied to the electroacoustic converter 10, the piezoelectric film 12 expands and contracts according to the applied drive voltage and moves in the forth-back direction.

Specifically, when the drive voltage is 0 V, this refers to a state shown in FIG. 4G, and the piezoelectric film 12 does not expand and contract.

In contrast, when a positive drive voltage is applied to the electroacoustic converter 10, the piezoelectric film 12 contracts in the in-plane direction. In order to absorb the contraction, as indicated by a broken line G1 in FIG. 4G, the inclined portion 12*b* of the piezoelectric film 12 changes in angle in the tilting direction, and the piezoelectric film 12 pushes the viscoelastic support 16. When the inclined portion 12*b* of the piezoelectric film 12 changes in angle in the tilting direction, this refers to, in other words, that the inclined portion 12*b* of the piezoelectric film 12 changes in angle in a direction of approaching the plane.

The positive voltage is a voltage application direction of the polarization processing. For this reason, if the positive drive voltage is applied, the piezoelectric film 12 extends in the film thickness direction and contracts in the in-plane direction.

Conversely, when a negative drive voltage is applied to the electroacoustic converter 10, the piezoelectric film 12 expands in the in-plane direction. In order to absorb the expansion, as indicated by a broken line G2 in FIG. 4G, the inclined portion 12*b* of the piezoelectric film 12 changes in angle in the rising direction, and the piezoelectric film 12 is pushed back to the viscoelastic support 16. When the inclined portion 12*b* of the piezoelectric film 12 changes in angle in the rising direction, this refers to, in other words, that the angle is changed so as to make the intersecting angle between the inclined portion 12*b* and the pressed portion of the piezoelectric film 12 approach 90°.

With the tilting of the inclined portion 12*b* and the pushing of the viscoelastic support 16 by the contraction of the piezoelectric film 12 and the rising of the inclined portion 12*b* and the pushing-back of the viscoelastic support 16 by the expansion of the piezoelectric film 12, the flat portion 12*a* of the piezoelectric film 12 moves minutely in the forth-back direction and sound is generated.

As described above, in an electroacoustic converter using a piezoelectric film in the related art, in order to obtain a sufficient sound volume, the piezoelectric film should have a curvature. However, in a case where the piezoelectric film has a curvature, since the piezoelectric film is curved, there is a restriction on an installation place or a mounting method, and there is a problem in that it is not appropriate for wall-mounting or installing on the rear surface of a picture, a poster, a decoration plate, or the like. If the area of the speaker becomes larger, there is a problem in that the thickness becomes larger even with a loose curvature, and the original feature as the thin speaker is degraded.

In contrast, in the electroacoustic converter 10 of the invention, the piezoelectric film 12 and the pressing sheet 20 are pressed to the viscoelastic support 16 to maintain the thickness of at least a part of the viscoelastic support 16 in the thinned state, and at least a part of a region other than a region of the piezoelectric film 12 near the holding member is formed substantially flat. For this reason, when the drive voltage is applied to the piezoelectric film 12, the angle of the inclined portion 12*b* slightly changes according to the expansion and contraction of the piezoelectric film 12, and the flat portion 12*a* moves in the forth-back direction, that is, vibrates while maintaining plane, thereby generating sound.

The electroacoustic converter 10 of the invention has the pressing sheet 20 which covers the piezoelectric film 12, and the piezoelectric film 12 is pressed by the pressing sheet 20 to further thin the viscoelastic support 16.

For this reason, it is possible to widen the flat portion 12*a* and to more efficiently generate sound compared to a case where the viscoelastic support 16 is pressed only by the piezoelectric film 12.

In addition, not only the force from below by the viscoelastic support 16 but also the force from above by the pressing sheet 20 are applied to the piezoelectric film 12 to be a generation source of sound. That is, in the electroacoustic converter 10 of the invention, a force is applied substantially evenly to the piezoelectric film 12 in the forth-back direction in which the piezoelectric film 12 vibrates, that is, in the direction orthogonal to the vibrating surface of the piezoelectric film 12. For this reason, the electroacoustic converter 10 of the invention, it is possible to make the large flat portion 12*a* move in the forth-back direction while preventing asymmetry in the forth-back direction, and excellent acoustic characteristics with distortion due to asymmetry of the forth-back movement suppressed are exhibited.

The pressing sheet 20 operates as a protective sheet of the piezoelectric film 12. For this reason, for example, even in a case of stabbing with a rod or the like, it is possible to prevent damage to the piezoelectric film 12. In addition, it is possible to make the electroacoustic converter 10 have a design characteristic by selecting the color, pattern, or the like of the pressing sheet 20.

In the electroacoustic converter 10 shown in FIG. 1 (and FIG. 4G), the pressing sheet 20 is fixed to the pressing member 18 in the tensioned state. That is, the pressing member 18 operates as the pressing member 18 which presses the viscoelastic support 16 to the piezoelectric film 12, and operates as a support member of the pressing sheet 20.

However, the invention is not limited thereto, and various configurations are available.

For example, a frame body having an opening into which the pressing member 18 is fitted or a frame body having a recess portion like the recess portion 18*a* in the lower end portion is used, and the pressing sheet 20 is tensioned and fixed to the frame body so as to close the opening of the frame body. Next, the pressing sheet 20 may be mounted in the electroacoustic converter in a state where the piezoelectric film 12 and the viscoelastic support 16 are pressed by attaching, to the pressing member 18, the frame body with the pressing sheet 20 fixed thereto.

The pressing sheet 20 is not limited to a configuration in which the pressing sheet 20 is fixed to the frame body in the tensioned state. That is, in a state of being fixed to the frame body, the pressing sheet 20 is not tensioned and is incorporated into the electroacoustic converter, and the pressing sheet 20 may be tensioned when the piezoelectric film 12 and the viscoelastic support 16 are pressed.

Figure 5A:
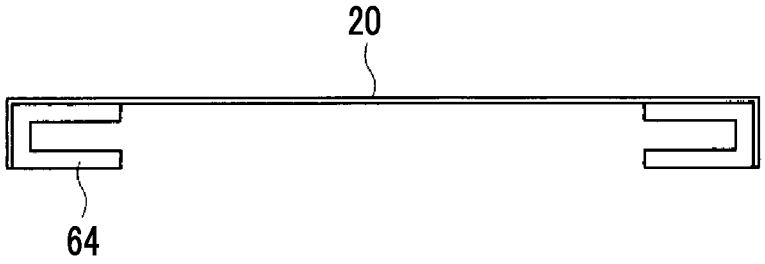
FIGS. 5A to 5D are conceptual diagrams illustrating another example of the method of manufacturing an electroacoustic converter of the invention.
Figure 5B:
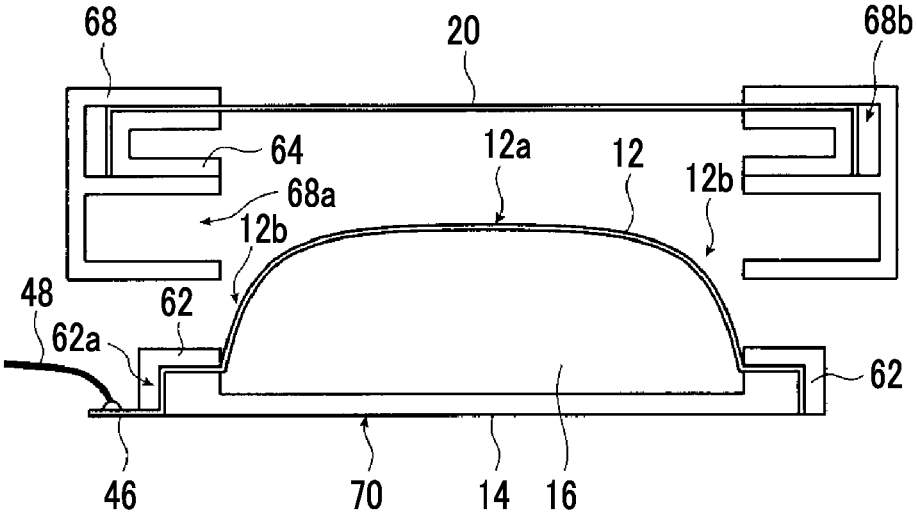
Figure 5C:
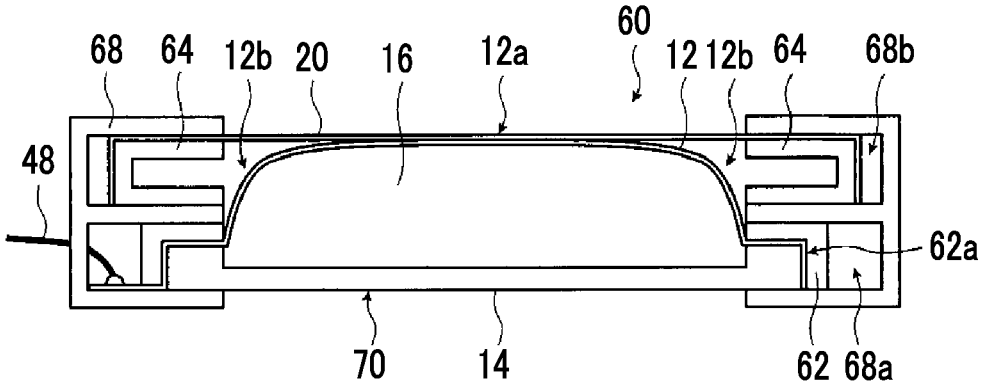

As a preferred configuration, an electroacoustic converter 60 conceptually shown in FIG. 5C (FIGS. 5A to 5D) is illustrated. Since the electroacoustic converter 60 shown in FIG. 5C uses many members the same as those of the electroacoustic converter 10 shown in FIG. 1, the same members are represented by the same reference numerals, and the following description will be primarily provided focusing on a difference.

The electroacoustic converter 60 shown in FIG. 5C has an inner frame 64 and an outer frame 68, in addition to a piezoelectric film 12, the case 14, a viscoelastic support 16, a pressing member 62, and a pressing sheet 20 the same as those of the electroacoustic converter 10.

In the electroacoustic converter 60, similarly to the pressing member 18 of the electroacoustic converter 10, while the pressing member 62 is a frame body and has a recess portion 62*a* which substantially has the same shape as the end portion (outer edge portion) of the case 14 in the lower end portion, and the piezoelectric film 12 is pressed and fixed in a state where the piezoelectric film 12 is interposed between the recess portion 62*a* and the outer edge portion of the case 14, the height is low.

In the electroacoustic converter 60 shown in FIG. 5C, the viscoelastic support 16 is housed in the cylindrical portion of the case 14. The piezoelectric film 12 has the peripheral portion fixed to the case 14 by the pressing member 62 and presses the viscoelastic support 16 to thin the entire viscoelastic support 16, and the piezoelectric film 12 itself forms the flat portion 12*a* and the inclined portion 12*b*.

Hereinafter, in the electroacoustic converter 60, an assembly of the piezoelectric film 12, the case 14, the viscoelastic support 16, and the pressing member 62 is referred to as a converter body 70.

A electrode lead-out portion 46 is provided in the piezoelectric film 12 (thin film electrode), and a wiring 48 is connected to the piezoelectric film 12.

In the electroacoustic converter 60, the pressing sheet 20 is supported by the inner frame 64.

The inner frame 64 is a rectangular frame body whose sectional shape with an opening side as an inner side is substantially a C shape, and has ridges on the same plane. The pressing sheet 20 covers the top surface of the inner frame 64 so as to close the opening of the inner frame and is fixed to the inner frame 64 in the tensioned state. Since the top surface of the inner frame 64 has the ridges on the same plane, the pressing sheet 20 supported in a state where the top surface of the inner frame 64 is tensioned is supported in a planar shape.

In the electroacoustic converter 60, the inner frame 64 supporting the pressing sheet 20 and the converter body 70 are loaded into the outer frame 68.

The outer frame 68 is a rectangular frame body whose sectional shape with a release side as an inner side is substantially an E shape. The converter body 70 is inserted into a lower recess portion 68*a* of the outer frame 68, and the inner frame 64 supporting the pressing sheet 20 is housed in an upper recess portion 68*b*.

Figure 5D:
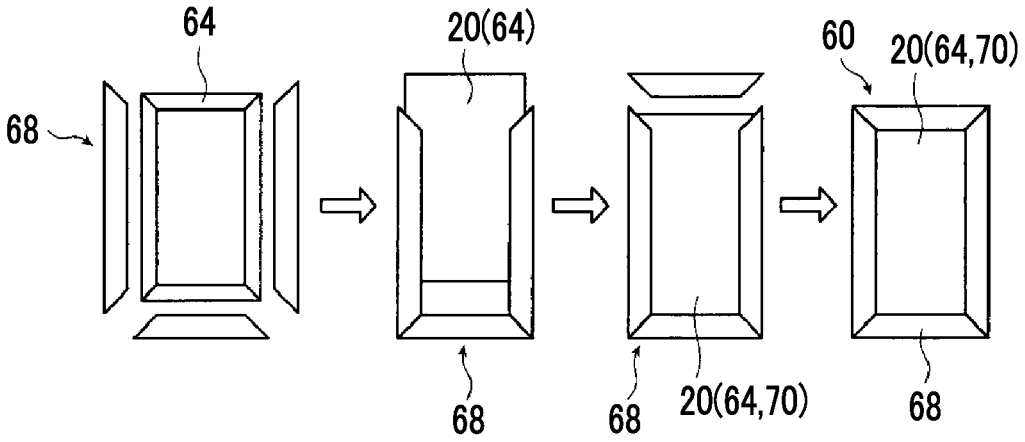

As shown in FIG. 5D, each of the inner frame 64 and the outer frame 68 which is a rectangular frame body is constituted by combining four sides constituting a rectangular frame.

When manufacturing the electroacoustic converter 60, first, the inner frame 64 is manufactured by combining the four sides. As shown in FIG. 5A, the top surface of the inner frame 64 is covered so as to close the opening of the inner frame 64 and the pressing sheet 20 is fixed to the inner frame 64 in a planar shape in the tensioned state.

Similarly to FIGS. 3A to 4E described above, the converter body 70 is assembled.

As shown in the second view from the left in FIG. 5D, the three sides of the outer frames 68 are assembled in a state where one side is open.

Next, as shown in FIG. 5B and the second view from the left in FIG. 5D, the inner frame 64 supporting the pressing sheet 20 is inserted into the upper recess portion 68*b* so as to be slipped from the opening end of the outer frame 68.

As shown in FIG. 5C and the third view from left in FIG. 5D, the converter body 70 is inserted into the lower recess portion 68*a* so as to be slipped from the opening end of the outer frame 68. If the converter body 70 is inserted into the outer frame 68, similarly to the above, the piezoelectric film 12 and the viscoelastic support 16 are pressed by the pressing sheet 20.

Finally, as shown in the rightmost view in FIG. 5D, the last one side of the outer frame 68 is assembled, and thus, the electroacoustic converter 60 is completed.

The electroacoustic converter 60 having the inner frame 64 and the outer frame 68 can constitute the pressing sheet 20 (inner frame 64) and the converter body 70 as independent structures.

For this reason, according to the electroacoustic converter 60, when the converter body 70 has failed, only the converter body 70 can be removed and repaired or replaced regardless of the pressing sheet 20. If only the pressing sheet 20 is replaced, the electroacoustic converter 60 may have a different appearance.

The electroacoustic converter 60 may operate the pressing sheet 20 as a screen and may project and display an image by a projector or the like. At this time, it is preferable that the pressing sheet 20 is made a color, such as white, easily watchable a projected image.

Although the electroacoustic converter of the invention has been described in detail, the invention is not limited to the above-described example, and various improvements or alterations may be of course made without departing from the concept of the invention.

EXAMPLES

Hereinafter, the invention will be described in more detail in connection with a specific example of an electroacoustic converter.

Example 1

The electroacoustic converter 10 shown in FIG. 1 (FIG. 4G) was manufactured by the assembling method shown in FIGS. 3A to 4G.

The inner shape of the case 14 and the pressing member 18, that is, the size of the surface generating sound was 290×175 mm. The depth of the cylindrical portion of the case 14 was 5 mm.

The piezoelectric film 12 was of a size of 300×185 mm and a thickness of 50 μm. The piezoelectric layer 30 used cyanoethylated PVA as the matrix 40 and used PZT as the piezoelectric body particles 42. The thin film electrodes 32 and 34 were made of a Cu thin film having a thickness of 0.1 μm, and the protective layers 36 and 38 were made of a PET film having a thickness of 4 μm.

For the viscoelastic support 16, glass wool having a size of 290×175 mm, a thickness of 25 mm before assembling, and density of 32 kg/m$^3$ was used.

For the pressing sheet 20, jersey fabric of smooth stitch having a thickness of 0.5 mm was used.

The viscoelastic support 16 was placed in the cylindrical portion of the case 14, the piezoelectric film 12 was disposed so as to cover the case 14 and the viscoelastic support 16, and the pressing member 18 was fixed to the case 14 while covering the pressing member 18 from above the piezoelectric film 12. The flat portion 12*a* and the inclined portion 12*b* were formed in the piezoelectric film 12. The flat portion 12*a* was higher than the upper end of the pressing member 18 by 5 mm.

The piezoelectric film 12 and the pressing member 18 are covered with the pressing sheet 20, and the pressing sheet 20 was pulled downward outside the pressing member 18 such that the pressing sheet 20 is supported by the pressing member 18 in a planar shape. In this state, the pressing sheet 20 was fixed to the pressing member 18, and thus, the electroacoustic converter 10 was manufactured.

Comparative Example 1

The electroacoustic converter was manufactured in the same manner as in Example 1, except that the pressing sheet 20 was not provided.

Comparative Example 2

An electroacoustic converter was manufactured in the same manner as in Example 1, except that wool felt having a size of 290×175 mm, a thickness of 15 mm before assembling, and density of 250 kg/m$^3$ was used as the viscoelastic support and the pressing sheet 20 was not provided.

For the electroacoustic converters manufactured in this manner, planarity, energy efficiency, and stab resistance were examined.

[Planarity]

The planarity of the piezoelectric film 12 was examined by applying a ruler in the longitudinal direction of the flat portion and measuring the length of the flat portion.

A case where the length of the flat portion was equal to or greater than 10 cm was evaluated as A, and a case where the length of the flat portion was less than 10 cm was evaluated as B.

[Energy Efficiency]

A sine wave of 1 kHz was input as an input signal to the electroacoustic converter through a power amplifier, and a sound pressure level ([dB/W/m]) was measured with a microphone placed at a distance of 50 cm from the center of the speaker.

[Stab Resistance]

The stab resistance of the electroacoustic converter was examined by dropping a steel ball having a diameter of 1 cm from a height of 50 cm to the center of the flat portion.

A case where a hole was not formed was evaluated as A, and a case where a hole was formed was evaluated as B.

The above results are shown in the following table.

TABLE 1

| | Pressing | Viscoelastic Support | | | Energy | Stab |
|---|---|---|---|---|---|---|
| | Sheet | Type | Density | Planarity | Efficiency | Resistance |
| Example 1 | Present | Glass Wool | 32 kg/m$^3$ | A | 80 dB/W/m | A |
| Comparative Example 1 | Absent | Glass Wool | 32 kg/m$^3$ | B | 80 dB/W/m | B |
| Comparative Example 2 | Absent | Wool Felt | 250 kg/m$^3$ | A | 76 dB/W/m | B |

As shown in the table, the electroacoustic converter of Example 1 is excellent in planarity, energy efficiency, and stab resistance.

In contrast, in Comparative Example 1 in which the pressing sheet 20 has not been provided, planarity is bad and stab resistance is insufficient. In Comparative Example 2 in which the pressing sheet 20 has not been provided and wool felt having density of 250 kg/m$^3$ has been used as the viscoelastic support, while planarity is excellent, energy efficiency is bad and stab resistance is insufficient.

The effects of the invention are apparent from the above-described effects.

EXPLANATION OF REFERENCES

10, 60: electroacoustic conversion film
12: piezoelectric film
14: case
16: viscoelastic support
18, 62: pressing member
20: pressing sheet
28: tab portion
30: piezoelectric layer
32, 34: thin film electrode
36, 38: protective layer
40: matrix
42: piezoelectric body particle
46: electrode lead-out portion
48: wiring
64: inner frame
68: outer frame

What is claimed is:

1. An electroacoustic converter comprising:

a piezoelectric film which has two principal surfaces facing each other, the principal surfaces expanding and contracting according to the state of an electric field;

a viscoelastic support which is disposed in close contact with one principal surface of the piezoelectric film;

a pressing member which presses the piezoelectric film to the viscoelastic support to maintain the thickness of at least a part of the viscoelastic support in a thinned state; and an expandable pressing sheet which is in close contact with the principal surface of the piezoelectric film opposite to the side in close contact with the viscoelastic support to press the piezoelectric film and the viscoelastic support and is supported in a tensioned state, wherein, in a section in a predetermined direction perpendicular to the principal surfaces of the piezoelectric film, the piezoelectric film has a flat portion which is substantially held linearly by the surfaces of the pressing sheet and the viscoelastic support in at least a portion thereof excluding the pressed portion pressed by the pressing member and an inclined portion which is connected to the pressed portion and the flat portion and extends in a direction of intersecting the pressed portion.

2. The electroacoustic converter according to claim 1, wherein the pressing sheet is supported by a frame body having ridges on the same plane while covering the ridges and an opening of the frame body.

3. The electroacoustic converter according to claim 2, wherein the pressing sheet is supported by the frame body in a planar shape in a tensioned state.

4. The electroacoustic converter according to claim 1, wherein the inclined portion has a curved portion.

5. The electroacoustic converter according to claim 4, wherein the curved portion has a region where the curvature thereof becomes larger in a direction from the flat portion toward the pressing member.

6. The electroacoustic converter according to claim 1, wherein the pressing sheet is jersey fabric.

7. The electroacoustic converter according to claim 6, wherein the stitch of the jersey fabric is any one of plain, fraise, span fraise, smooth, punch, sweat, and rib.

8. The electroacoustic converter according to claim 1, wherein the piezoelectric film has a polymeric composite piezoelectric body in which piezoelectric body particles are dispersed in a viscoelastic matrix made of a polymer material having viscoelasticity at normal temperature and electrode layers provided so as to sandwich the polymeric composite piezoelectric body therebetween.

9. The electroacoustic converter according to claim 1, wherein the viscoelastic support is glass wool.

10. The electroacoustic converter according to claim 9, wherein the specific gravity of the glass wool is 10 to 32 kg/m$^3$.

11. The electroacoustic converter according to claim 1, wherein the inclined portion is not connected to the surfaces of the pressing sheet.

12. The electroacoustic converter according to claim 1, wherein the expandable pressing sheet has no curvature.

* * * * *